United States Patent [19]

Hutchinson et al.

[11] 4,074,097

[45] Feb. 14, 1978

[54] FLUID RESPONSIVE SEALED PIVOT ARM MEANS

[76] Inventors: Harold D. Hutchinson, 26734 W. Latigo Shore Drive; William C. Gregge, 6902 S. Fernhill Drive, both of Malibu, Calif. 90265

[21] Appl. No.: 733,475

[22] Filed: Oct. 18, 1976

[51] Int. Cl.[2] ..... H01H 35/40

[52] U.S. Cl. ..... 200/81.9 R; 200/61.2; 200/153 T; 200/302; 73/228; 74/18.1

[58] Field of Search ..... 200/302, 153 T, 81.9 R, 200/61.2, 84 R; 74/18.1; 277/174; 340/239 R, 244 B; 73/317, 318, 228

[56] References Cited

U.S. PATENT DOCUMENTS

| | | | |
|---|---|---|---|
| 3,148,254 | 9/1964 | Clason | 200/81.9 R |
| 3,303,852 | 2/1967 | Miller | 74/18.1 |
| 3,393,563 | 7/1968 | Gelinas | 73/228 |
| 3,424,011 | 1/1969 | Pontis | 74/18.1 |
| 3,501,605 | 3/1970 | Hutchinson | 200/81.9 R |
| 3,963,889 | 6/1976 | Stonich | 200/81.9 R |

*Primary Examiner*—Gerald P. Tolin
*Attorney, Agent, or Firm*—Ralph B. Pastoriza

[57] ABSTRACT

A pivot arm is used in a liquid flow switch or liquid level device to transmit a force generated within a fluid chamber through the wall of the chamber to the outside. A pivot pin pivots the arm in a bore in an insert in the wall and a seal is provided in the form of a rolling diaphragm having its outer periphery sealed to the periphery of the bore and its inner portion sealed to the arm. Rocking movement of the arm is subject to very little resistance by the rolling diaphragm and yet the necessary fluid tight seal is maintained. The rocking movement is protected against contamination by a unique flexible boot and filter combination.

4 Claims, 5 Drawing Figures

FLUID RESPONSIVE SEALED PIVOT ARM MEANS

This invention relates generally to flow switches, level indicators and the like and more particularly to an improved fluid responsive sealed pivot arm means for physically transferring movement and force within a fluid chamber to the exterior of the chamber while maintaining a proper seal at the point the pivot arm passes through the wall of the fluid chamber.

BACKGROUND OF THE INVENTION

In our U.S. Pat. No. 3,501,605 issued Mar. 17, 1970 there is disclosed a fluid responsive switch utilizing a pivoted arm passing through a bore in a wall of a fluid chamber through which fluid such as a liquid passes. The primary function of the arm is to transmit a force generated within the fluid chamber through a wall of the chamber to the outside. This force when transmitted to the exterior of the chamber wall can be used to operate a micro-switch and thus provide a signal should the fluid flows deviate from a given flow rate. The same type of pivoted arm structure could be used in liquid level indicators to indicate a deviation in a liquid level.

In all such applications, the seal separating the interior and exterior of the chamber through which the pivot arm extends, is an extremely critical element. It must form a flexible water and/or air tight seal at the various pressure differentials, over extended temperature ranges for a wide variety of corrosive and non-corrosive fluids.

In the past, as in the case of our above-referred to United States Patent, such sealing is accomplished by a molded elastic collar configuration. In the prior art structures, metal bellows have been utilized, magnetic couplings, bending tubular type beams and the like.

While many of the foregoing prior art systems have been satisfactory, problems have arisen particularly when the liquid involved is contaminated; that is, including sludge, metal chips and the like. Such particles tend to restrict movement of the pivot arm in which event the rocking action of the arm will be impeded. The sensitivity of the device is thus affected.

BRIEF DESCRIPTION OF THE PRESENT INVENTION

With the foregoing considerations in mind, the present invention contemplates an improved fluid responsive sealed pivot arm arrangement wherein appropriate sealing is provided and yet wherein almost negligible resistance to rocking movement of the arm results.

More particularly, in accord with the present invention, a bore is provided in a body cooperating with a portion of a fluid chamber wall through which appropriate arm means pass. A pivot pin extends from diametrically opposite points on a central portion of the arm means passing through the bore, the pin extending transversely across the bore to pivot the arm means for rocking movement. Sealing is accomplished by a rolling diaphragm having its outer peripheral portion sealed to the body about the periphery of the bore and its inner portion sealed to the arm means, the annular convoluted rolling portion of the rolling diaphragm being positioned within the annulus between the bore and pivot arm means. Rocking movement is thus accommodated by the rolling portion of the diaphragm.

While rolling type diaphragms per se are known in the art, they are always used in conjunction with linear motion in a direction normal to the plane of the diaphragm. In the instant invention, the rolling diaphragm functions to accommodate a pivoting or rocking motion.

In those instances wherein the liquid involved in the fluid chamber is contaminated, an additional element is provided in the form of a flexible boot and filter combination which loosely surrounds the inner portion of the arm means within the fluid chamber and is secured about the periphery of the bore to block out particles from passing under the rolling portion of the rolling diaphragm while permitting the liquid itself to flow into the rolling portion of the diaphragm.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
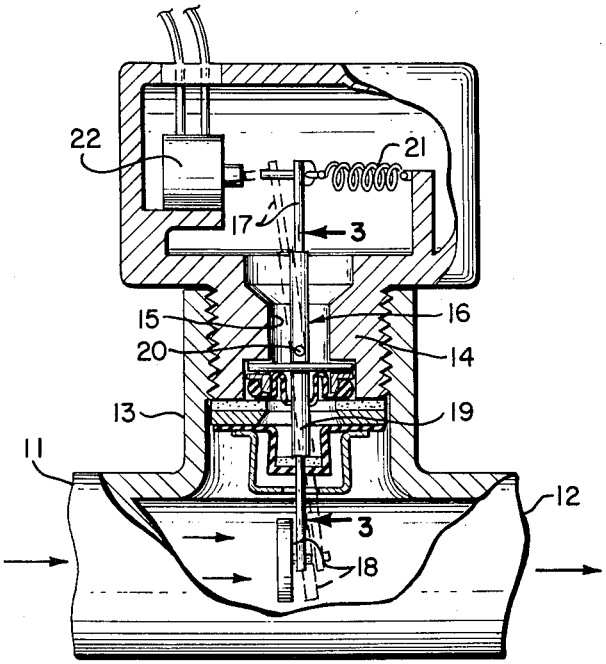
FIG. 1 is a broken away side elevational view of one type of fluid chamber to which a flow switch is secured incorporating the fluid responsive sealed pivot arm means of the present invention.

Referring first to FIG. 1, there is indicated by the numeral 10 a fluid chamber which, in the particular embodiment chosen for illustrative purposes, is designed to cooperate with a fluid flow switch. Thus, there is shown an inlet 11 and outlet 12 to the chamber 10 through which fluid passes in a given direction.

As shown, a portion 13 of the fluid chamber includes a threaded opening for receiving a body 14 in the form of a threaded insert. Insert 14 includes a bore 15 communicating with the fluid chamber. An arm means designated generally by the numeral 16 passes through this bore so that an outer end of the arm means 17 is exterior of the fluid chamber 10 an inner end 18 is disposed within the fluid chamber 10, and a central portion 19 is positioned within the bore 15.

A pivot pin 20 passes transversely across the bore 15 into the central portion 19 of the arm means for pivoting the arm means for rocking movement in a given plane. In FIG. 1, the direction of the pivot pin 20 is normal to the plane of the drawing so that the arm means itself will rock in the plane of the drawing.

With the foregoing arrangement described thus far, it will be evident that liquid flowing through the inlet 11 and chamber 12 will exert a dynamic drag force on the interior portion 18 of the arm means 16 tending to move it to the right as viewed in FIG. 1, this motion being transmitted to a leftward movement of the outer portion 17 of the arm. A biasing means 21 in the form of a spring is provided exterior of the fluid chamber and connected to the outer portion 17 to bias it to rock in a direction opposing that of the fluid flow, thus creating a force-balance condition when the spring is adjusted to balance the interior fluid dynamic drag force. A micro-switch 22 is similarly provided exterior of the fluid chamber and positioned to be engaged by the outer portion of the arm means 17 should the fluid flow deviate from a given rate by a given amount, thereby upsetting the force-balance condition.

As an example of the foregoing, the fluid flow rate could be such as to cause the outer portion 17 of the arm to engage the micro-switch 22 and hold it in an open condition assuming that the switch is of the normally closed type. Should the fluid flow rate decrease so that the dynamic force exerted on the inner portion of the arm decreases, the upper portion will move away from the microswitch 22 permitting it to close and thus complete an alarm circuit. In other applications, as mentioned heretofore, the rocking arm means 16 may be used to indicate a change in liquid level.

Figure 2:
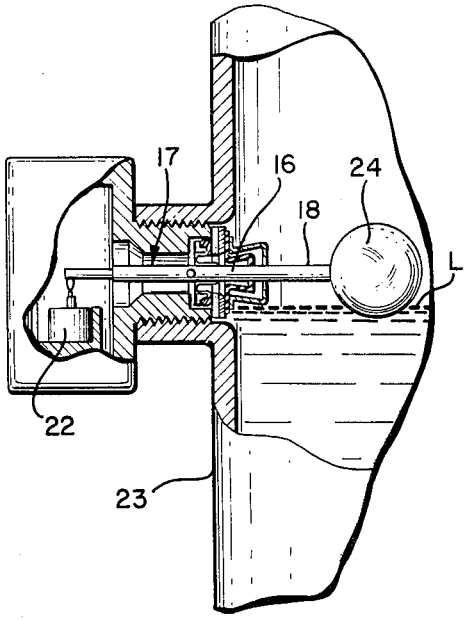
FIG. 2 is another fluid chamber illustrating the use of the sealed pivot arm means of the present invention as a liquid level indicator.

Thus, referring to FIG. 2, there is shown a fluid chamber in the form of a reservoir or tank 23. Communicating with the interior of this tank through an appropriate side opening is the inner portion 18 of the pivot arm means 16, this structure differing only from the embodiment of FIG. 1 in that it terminates in a float 24, is disposed in a horizontal position and spring 21 is omitted. The actual location of the pivot arm means 16 is such that when the liquid in the tank 23 is at a given level L or above such level, the buoyancy provided by the liquid 21 is sufficient to maintain the outer end portion 17 in engagement with the contact of the micro-switch 22. If this is a normally closed micro-switch, the switch will be held open by the outer arm portion 17.

If the liquid level L should now drop below a predetermined level, the weight of the float will cause the exterior arm portion 17 to rock upwardly thus releasing the micro-switch and permitting it to close and sound an alarm.

In all such applications such as illustrated in FIGS. 1 and 2, it is important that the rocking motion take place and yet a proper fluid tight seal be assured at the points where the arm passes through the wall of the fluid chamber.

Figure 3:
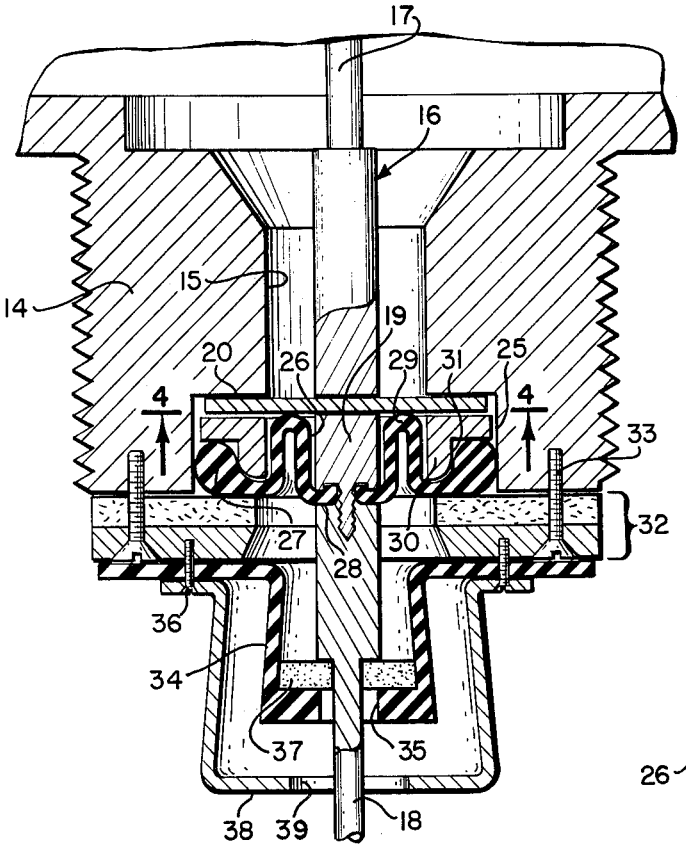
FIG. 3 is greatly enlarged fragmentary cross section of the pivot arm means itself taken in the direction of the arrows 3—3 of FIG. 1.

Referring now to the enlarged cross section of FIG. 3, details of the improved pivot seal in accord with the present invention will be evident. As shown, the body 14 includes an increased diameter portion 25 at the end of the bore 15 where it opens into the fluid chamber. This increased diameter portion 25 cooperates with a rolling diaphragm indicated generally at 26 having an outer periphery terminating in a bead 27 similar to an O-ring received in the enlarged portion 25. The inner portion of the rolling diaphragm 26 is shown at 28 and is secured to the central portion 19 of the arm means 16. The portion of the rolling diaphragm between its periphery and inner portion is folded to define an annular rolling portion as indicated at 29 within the annulus defined between the bore 15 and central portion 19 of the arm means. In this respect, the bore 15 is of a given diameter and the central portion of the arm means 19 is of a smaller diameter to provide the described annulus.

In the perferred embodiment, there is also provided a first washer 30 having an annular exterior stepped portion 31. The annular bead portion 27 of the rolling diaphragm 26 is actually cradled in this exterior annular stepped portion of the first washer 30 in the increased diameter portion 25.

Overlying the annular bead and first washer is a washer assembly 32 secured to the body 14 about the periphery of the increased diameter portion 25 of the bore 15 as by screws 33. The washer assembly 32 may comprise actually two washers, the upper washer as illustrated in FIG. 3 in direct contact with the underside of the body 14 having a reinforcing mesh medially while the lower washer constitutes a relatively stiff metallic washer. This washer assembly 32 will retain the first washer 30 and bead portion 27 of the rolling diaphragm within the increased diameter portion 25 of the body 14.

Preferably, the seal through arrangement also includes a flexible boot 34 loosely fitted around the interior portion 18 of the arm means 16 as at 35 and secured to the washer assembly 32 as by fastening screws one of which is shown at 36. A porous filter 37 is positioned within the area 35 of the flexible boot. The loose fit of this boot together with the filter 37 permits water or other liquid to fill in the convolute of the rolling diaphragm defined by the folling portion 29 and yet will block particles or solid debris from entering this area which particles might otherwise restrict motion of the pivot arm means.

The assembly is completed by the provision of an appropriate stop means which might comprise a spider structure 38 secured by the same screws supporting the flexible boot 34 to the washer assembly 32 and incorporating a large opening 39 surrounding the inner portion 18 of the pivot arm. This opening will limit by its inner edges the amplitude of movement of the arm which movement is normal to the plane of the drawing as viewed in FIG. 3.

Figure 4:
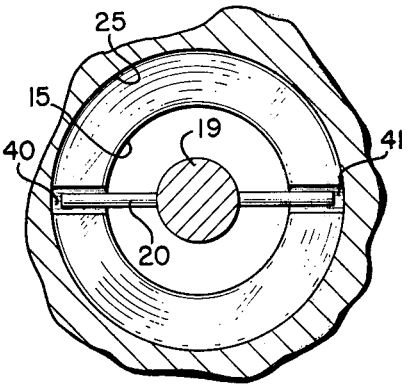
FIG. 4 is a fragmentary cross section taken in the direction of the arrows 4—4 of FIG. 3; and, FIG. 5 is an exploded perspective view illustrating a first washer and the rolling diaphragm itself with portions broken away useful in explaining details of the invention.

The increased diameter portion of the bore 15 described in FIG. 3 and the manner of pivoting of the arm by the pivot pin 20 will become clearer by now referring to the fragmentary cross section of FIG. 4 taken in the direction of the arrows 4—4 of FIG. 3. As shown in FIG. 4, it will be noted that the pin 20 simply extends from diametrically opposite points of the central portion 19 of the arm means to extend across the bore 15 and rest in opposite grooves 40 and 41 formed in the floor of the increased diameter portion 25, thereby providing a pivoting arrangement which will prevent longitudinal movement of the arm means upwardly through the bore.

Figure 5:
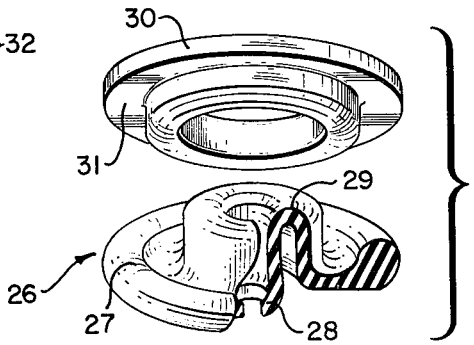

FIG. 5 illustrates in better detail the first washer 30 with the exterior annulus step 31 which washer 30 fits within the increased diameter portion 25 of FIG. 4, thus serving to hold the end portions of the pivot pin 20 in the grooves 40 and 41, the grooves being of sufficient depth that the washer 30 will not actually contact these pin portions. Thus, the pins are relatively "loose" but restrained against downward movement by the washer.

The same washer 30 with the stepped portion 31 cradles the annular bead 27 of the rolling diaphragm as described in the assembled view of FIG. 3. In FIG. 5, the rolling diaphragm 26 is shown in perspective partially cut away to expose the convoluted or rolling portion 29. The inner portion 28 of the rolling diaphragm is pierced to recieve a threaded stud received within a tapped hole provided in the central portion 19 of the arm means as illustrated in FIG. 3. However, rather than form the arm means in connectable sections as illustrated in FIG. 3, any appropriate means may be provided to seal the inner portion 28 of the rolling diaphragm to the central portion 19 of the arm means.

OPERATION

Regardless of the particular application to which the sealed pivot arm means is applied, the action is the same. Thus, when the portion of the arm means in the fluid chamber is caused to move by action of the fluid, the arm means will rock about the pivot pin 20 as described and as depicted by the dashed phantom lines in FIG. 1. The outer portion 17 of the arm executes a motion similar to that of the inner portion but in an opposite direction so that motion is physically transmitted through the rocking action. The rocking movement itself is easily accommodated by the roll portion 29 of the rolling diaphragm 26, very little distortion of the diaphragm resulting from this rocking motion so that a minimum resistance to such rocking motion by the diaphragm is exerted. On the other hand, an excellent seal is maintained over a wide variation in differential pressures between the interior and exterior of the fluid chamber.

While the flexible boot 34 described in FIG. 3 is shown, it is not an essential element of the seal through arrangement where the liquid or other fluids involved are not in any way contaminated with particles. On the other hand, should there be particulate matter in the liquid, the boot and filter combination is a desirable feature in that it prevents large particles from reaching the convolute portion of the rolling diaphragm and possibly damaging and/or restricting its flexibility.

It will be understood, of course, that the pivot pin 20 as stated prevents axial movement of the arm means within the bore. Thus, the rolling diaphragm will not be stressed in the usual manner of a rolling diaphragm to accommodate axial movement but will only be distorted to the extent necessary to accommodate the rocking motion which is extremely small particularly since the rolling portion of the diaphragm is close to the pivot pin 20.

The mechanical stop 38 limits the amplitude of swinging movement of the arm means and thus prevents damaging of the rolling portion of the rolling diaphragm when portions of the annulus are narrowed as a consequence of rocking of this arm means.

From the foregoing description, it will thus be evident that the present invention has provided a unique and reliable fluid responsive sealed pivot arm means which overcomes certain problems heretofore encountered in the prior art all as set forth herein.

We claim:

1. A fluid response sealed pivot arm means inserted in a fluid chamber portion and responsive to fluid movements in said chamber to physically rock and thereby transmit the movement to the exterior of the chamber, said sealed pivot arm means including, in combination:

a. body means communicating with said portion of the fluid chamber and including a bore of given diameter having an increased diameter portion at the end of said bore opening into said fluid chamber;

b. an elongated arm means passing through said bore so that an outer end is exterior of the chamber, an inner end is within the chamber, and a central portion is in said bore;

c. a pivot pin passing transversely across said bore and into said central portion of said arm means for pivoting the arm means for rocking movement, the central portion of the arm means having a diameter less than said given diameter to define within the inside wall of said bore an annulus;

d. a rolling diaphragm having its outer periphery terminating in an annular bead received in said increased diameter portion, the inner portion of said diaphragm being secured to said arm means, the annular portion of the diaphragm between its inner portion and outer periphery folding to define an annular rolling portion filling said annulus between the inner wall of said bore and the outer wall of said central portion of said arm means so that rocking movement of said arm means can be accommodated by said rolling portion of said diaphragm while said diaphragm provides a fluid tight seal between the fluid chamber and exterior;

e. a washer assembly overlying said annular bead and secured to said body means to retain the annular bead in said increased diameter portion of said bore; and, f. a flexible boot and filter combination secured to said washer assembly loosely surrounding said inner portion of said arm means for excluding particles in the fluid from passing into said annulus beneath the rolling portion of said diaphragm.

2. A fluid responsive sealed pivot arm means according to claim 1, further including a first washer having an annular exterior stepped portion received in said increased diameter portion of said bore for cradling said annular bead of said rolling diaphragm.

3. A fluid responsive sealed pivot arm means according to claim 2, in which said body means comprises a threaded insert said portion of said fluid chamber defining a threaded opening receiving said insert, said fluid chamber having fluid inlet and outlet openings for passing fluids in a direction through the chamber to flow past said inner portion of said arm means and exert dynamic drag force thereon to rock the arm means in a first direction on said pivot pin; a biasing means biasing said arm means to rock in a direction opposing the direction of fluid flow; and a micro-switch exterior of said fluid chamber positioned to be engaged by said outer portion of said arm means when said arm means rocks through a given distance so that said micro-switch is operated by said outer portion of said arm means when said fluid flow rate deviates from a given value by a given amount.

4. A fluid responsive sealed pivot arm means according to claim 2, in which said fluid chamber comprises a liquid reservoir holding liquid at a given level, the inner end of said arm means terminating in a float such that changes in said liquid level rocks said arm means about said pivot pin through a given distance, and a micro-switch positioned to be operated by said outer portion of said arm means when said liquid changes level from said given level.

* * * * *